US006021541A

United States Patent [19]

Mori et al.

[11] Patent Number: 6,021,541

[45] Date of Patent: Feb. 8, 2000

[54] TOOTHBRUSH

[75] Inventors: Toyokazu Mori, Takatsuki; Shinya Sakurai, Nagaokakyo; Hitoshi Matsumoto, Suita; Koki Nishimura; Koichi Kubo, both of Okazaki, all of Japan

[73] Assignee: Sunstar, Inc., Osaka, Japan

[21] Appl. No.: 09/194,681

[22] PCT Filed: Jun. 5, 1997

[86] PCT No.: PCT/JP97/01966

§ 371 Date: Dec. 1, 1998

§ 102(e) Date: Dec. 1, 1998

[87] PCT Pub. No.: WO97/46137

PCT Pub. Date: Dec. 11, 1997

[30] Foreign Application Priority Data

Jun. 5, 1996 [JP] Japan ..... 8-142789

[51] Int. Cl.[7] ..... A46B 9/04

[52] U.S. Cl. ..... 15/167.1; 15/207.2

[58] Field of Search ..... 15/207.2, 167.1

[56] References Cited

U.S. PATENT DOCUMENTS 5,926,897 7/1999 Volpenhein ..... 15/207.2

FOREIGN PATENT DOCUMENTS 1094324 5/1955 France ..... 15/207.2
63-131641 8/1988 Japan .
7-231813 9/1995 Japan .
479277 11/1969 Switzerland ..... 15/207.2

*Primary Examiner*—Randall E. Chin
*Attorney, Agent, or Firm*—Armstrong, Westerman, Hattori, McLeland & Naughton

[57] ABSTRACT

A toothbrush is manufactured by planting sheath/core type composite fibers in a planting base, wherein the sheath/core type composite fiber further comprises: a composite portion consisting of a sheath portion made from polyester resin and 2 to 5 of core portions made from polyamide resin dispersed therein having a predetermined length from a planted base portion; and 2 to 5 of exposed core filament portions obtained by exposing the core portions only having a predetermined length on an end side from the composite portion.

6 Claims, 10 Drawing Sheets

(a)

(b)

(b)

(c)

TOOTHBRUSH

BACKGROUND OF THE INVENTION

1. Field of the Invention

The present invention relates to a toothbrush which has an improved cleaning effect for details in the oral cavity such as interdental portions, cervical portions, pit & fissure where it is considered that plaques are liable to accumulate and it is difficult to remove the accumulated plaques with an ordinary toothbrush.

2. Description of the Related Art

Since plaques are apt to accumulate in interdental portions, cervical portions, pit & fissure and the like and yet it is difficult to remove the accumulated plaques, a toothbrush which can effectively clean these details in the oral cavity has been desired.

As the toothbrush for the purpose of cleaning these details in the oral cavity, there is known a toothbrush whose end is sharply tapered as disclosed in Japanese Unexamined Patent Publication No. 141923 of 1994.

Since this toothbrush has tapered filaments, it has an advantage that the end of the filament can be easily inserted into details in the oral cavity. On the other hand, since it has a relatively sharp end structure, it has a disadvantage that it injures or hurts the gum tissue. Further, since the stiffness of the filament is apt to be insufficient and the total area of the end surfaces of the filaments in contact with a site to be cleaned is small, it has such a disadvantage that its sweeping force is weak and a satisfactory plaque removal effect cannot always be obtained.

On the other hand, there is available a technique by which details can be cleaned with a composite monofilament whose end portion is divided into a plurality of superfine fibers. Examples of such a technique include Japanese Unexamined Patent Publication No. 277117 of 1994, No. 231813 of 1995 and No. 99604 of 1991. The term "composite monofilament" means that a single monofilament is formed by composing different materials of fibers.

Japanese Unexamined Patent Publication No. 277117 of 1994, for example, proposes a use of a composite filament prepared by coating a bundle of superfine fibers thereof with a synthetic resin, and removing the coated resin from a predetermined range of an end portion thereof to expose the superfine fibers.

Also, Japanese Unexamined Patent Publication No. 231813 of 1995 proposes a technique in which a composite monofilament is used which is prepared by spinning a polymer mixture containing a component easy to be dissolved, using a melt spinning machine, planting the obtained monofilaments in a handle, and immersing end portions of the monofilaments in a hydrolyzing agent such as an aqueous solution of sodium hydrate to have the end portions corroded so as to divide the end portions at random.

A brush using the above composite monofilaments whose each end portion is divided into several superfine fibers is soft and does not injure an object to be cleaned because the superfine fibers at the end of the monofilament are brought into contact with the object to be cleaned. In addition, the brush can exhibit appropriate stiffness because portions of the monofilament other than the end portion are integrated.

However, since the technique proposed by Japanese Unexamined Patent Publication No. 277117 of 1994 relates to a general brushes including car washing brushes, painting brushes, and the like, investigations on problems specific to toothbrushes are unsatisfactory and hence, a problem occurs when this technique is applied to a toothbrush.

In other words, Japanese Unexamined Patent Publication No. 277117 of 1994 discloses a technique in which a bundle of core filaments is integrated by coating with a resin. However, in such a composite monofilament, since water remains in a space between core filaments, various bacteria are apt to propagate in the space, which is insanitary. Further, the coated resin enclosing the core filaments has such a problem that it readily cracks and is inferior in durability.

Further, in the technique disclosed in Japanese Unexamined Patent Publication No. 231813 of 1995, since an end portion of the monofilament containing a component easy to be dissolved is divided into a plurality of fibers by the dissolution of the component easy to be dissolved, it is difficult to control the number and diameter of core filaments. In addition, like Japanese Unexamined Patent Publication No. 277117 of 1994, there is a fear that initial stiffness may not be maintained due to the cracking of the root of a separated portion during use.

A technique which overcomes the above problems to some extent is disclosed in Japanese Unexamined Patent Publication No. 99604 of 1991. A composite monofilament used herein is prepared by forming sheath/core type composite fiber portion (to be referred to as "composite portion" hereinafter) in which a sheath portion is studded with core portions made from a resin different from that of the sheath portion in a predetermined range of the monofilament from a planted base portion and a group of core filaments in an end portion from the composite portion by exposing only the core portions.

Since a resin is filled between the core filaments in this composite monofilament, water does not enter the planted base portion from the core filament base portion and there is no risk that the base portion of the core filament cracks during use. Further, since the number and the diameter of the core filaments can be controlled, a composite monofilament having a desired specification can be obtained and there is the possibility that it can be used as a composite monofilament for a toothbrush which lays stress on cleaning properties for details.

However, since the technique disclosed in this publication is directed to general brushes including car washing brushes, painting brushes, and the like, no consideration is given to specific conditions when this technique is applied to a toothbrush, and the configuration of a toothbrush making the most use of an advantage of this composite monofilament is not proposed therein.

SUMMARY OF THE INVENTION

The present invention has been made in view of the above circumstances and therefore has an object to provide a toothbrush which has an excellent cleaning effect for details in the oral cavity where it is considered that plaques are liable to accumulate and it is difficult to remove the accumulated plaques with an ordinary toothbrush, such as interdental portions, cervical portions, pit & fissure. More specifically, the present invention has an object to provide a toothbrush whose filaments have a stiffness in spite that they are so soft to the gum tissue that they do not injure or hurt the gum tissue, and is excellent in plaque removing effect, and also has an object to define the conditions of a composite monofilament which can attain the above object in consideration of problems inherent in a toothbrush.

To solve the problems described above, the inventors of the present invention have conducted an intensive study on the characteristic properties of a toothbrush required to improve cleaning properties for details in the oral cavity, such as interdental portions, cervical portions, pit & fissure, and have reached a conclusion that a toothbrush for attaining the above object must have the following features.

Firstly, as a basic configuration of a composite monofilament may be employed what is disclosed in Japanese Unexamined Patent Publication No. 99604 of 1991, that is, what has a composite sectional structure that a sheath portion is studded with core portions and a resin constituting the sheath portion encloses the core portions and fills a space between adjacent core portions on a planted base portion side and has a structure that a predetermined length of the core portions only are exposed to constitute core filament portions on an end portion side (to be referred to as "sheath/core type composite fiber", a portion where a sheath portion and core portions are present on a base portion side is referred to as "composite portion"). A polyamide resin is used as a material of the core portion (to be referred to as "core component" hereinafter) and a polyester resin is suitably used as a material of the sheath portion (to be referred to as "sheath component" hereinafter). Further, the number of core filaments is selected from a range of 2 to 5.

A diameter of the composite portion is preferably selected from a range of 0.15 to 0.3 mm; a diameter of the core filament, from a range of 0.03 to 0.07 mm; and a length of the exposed core filament, from a range of 0.2 to 4.0 mm, more preferably 0.5 to 4.0 mm.

A length from the planted base portion to the distal end of the sheath/core type composite fiber planted is preferably set to a range of 7 to 11 mm.

A predetermined range of an end portion of the composite portion is preferably tapered.

A degree of tapering the end portion of the composite portion is such that when a diameter of the root portion of the composite portion is 100% and the boundary between the exposed core filament and the composite portion is made a reference point, a diameter at a position 1 mm from the reference point toward the side of the composite portion is 70±15%; a diameter at a position 3 mm from the reference point, 89±8%; the diameter at a position 5 mm from the reference point, 93±7%.

A toothbrush of the present invention is configured such that all or part of 2 to 5 core filaments exposed at the end of each composite monofilament are inserted into details in the oral cavity, such as interdental spaces, cervical portions, pit & fissure, and the composite portion located behind thereof maintains the stiffness of the whole composite monofilament. The core filaments are fine filaments, thereby being easily inserted into these portions and soft. Further, since they are made from a polyamide resin, they exhibit appropriate water absorption properties and are well adapted to the teeth and gum. Therefore, the core filaments do not injure or hurt the gum tissue even when they come into contact with the gum.

Further, sheath component fills spaces around and between core portions compactly, and therefore water does not enter the composite portion from the core filament base portion and the composite portion does not crack from the core filament base portion during use. In addition, as the sheath component is a polyester resin, it has low water absorption properties, thereby being excellent in underwater use.

When a diameter of the composite portion is set to a range of 0.150 to 0.300 mm; a diameter of the core filament, a range of 0.03 to 0.07 mm; and a length of the exposed core filament, a range of 0.2 to 4.0 mm, insertibility into details in the oral cavity, reachability for the inner parts of details in the oral cavity and the effect of removing plaques with the reached core filaments are more preferred. When the length of the exposed core filament is set to a range of 0.5 to 4.0 mm, insertibility into details in the oral cavity, reachability for the inner parts of details in the oral cavity and the effect of removing plaques with reached core filaments are much more preferred.

When a length from the planted base portion to the distal end of the planted sheath/core type composite fiber is in a range of 7 to 11 mm, sufficient stiffness for obtaining a cleaning effect, excellent insertibility into an interdental space and good manipulation ease can be obtained.

Insertibility into and reachability for details are further enhanced by tapering a predetermined range of the end portion of the composite portion.

BRIEF DESCRIPTION OF THE DRAWINGS

In the accompanying drawings:

FIGS. 10A to 10D show various shapes of a filament used to confirm the effect of the present invention, in which FIG. 10A shows the composite monofilament of the present invention, 10B a filament having a tapered end portion, 10C a filament having a sharply tapered end portion and 10D a filament having a rounded end portion;

DETAILED DESCRIPTION OF THE PREFERRED EMBODIMENTS

Figure 1:
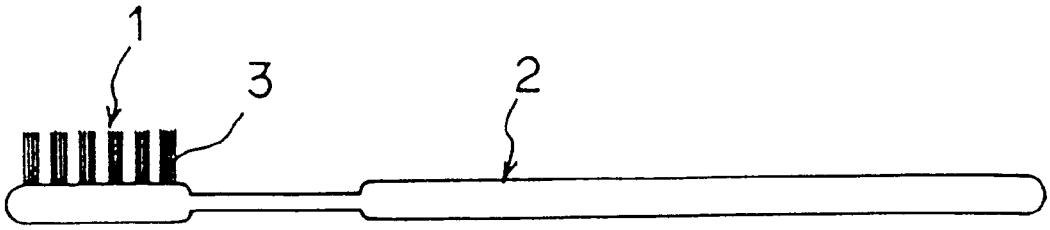
FIG. 1 is a front view showing a toothbrush according to an embodiment of the present invention.
Figure 2:
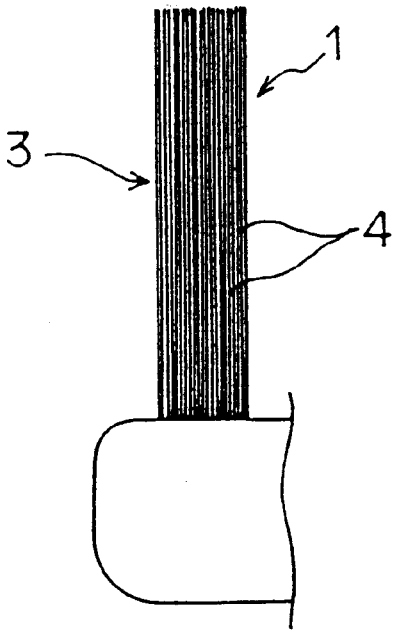
FIG. 2 is an enlarged front view showing part of a planted portion where bundles of composite monofilaments are planted.

Now, the present invention is described in detail. FIG. 1 shows a standard type of a toothbrush which consists of a planted portion 1 and a handle 2. The toothbrush which the present invention is directed to includes not only such a standard type but also those which consist of planted portions 1 and handles 2 having different shapes. The planted portion 1 is formed by assembling bundles 3 of filaments as shown in FIG. 2 and each bundle 3 of filaments consists of 10 to 40 filaments 4. A monofilament which is a single fiber is generally used as the filament 4, however a composite monofilament whose end portion is separated into several filaments is used in the present invention.

Figure 3:
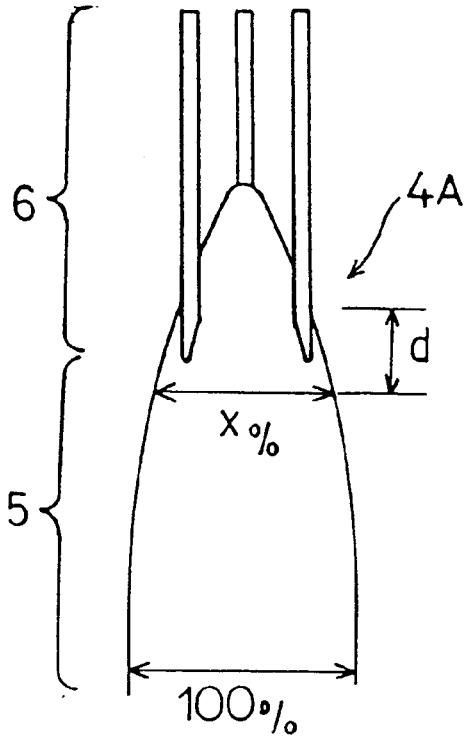
FIG. 3 is a diagram for explaining the configuration of a composite monofilament used in the present invention.

FIG. 3 illustrates a composite monofilament 4A used in the present invention. The composite monofilament 4A consists of a composite portion 5 and a separated portion 6. The specific configuration of this composite monofilament is important in the present invention.

Figure 4:
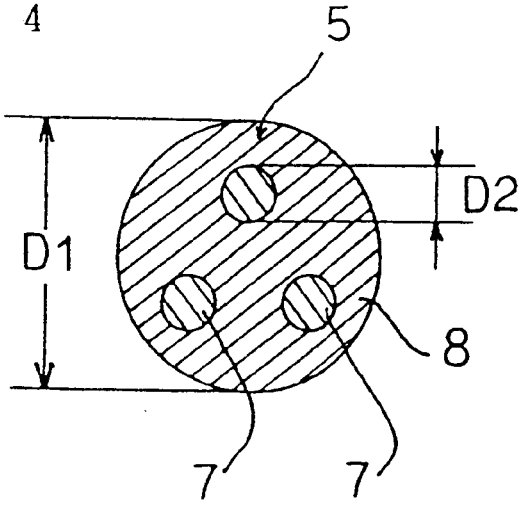
FIG. 4 is a sectional view of a composite portion of the composite monofilament.
Figure 5:
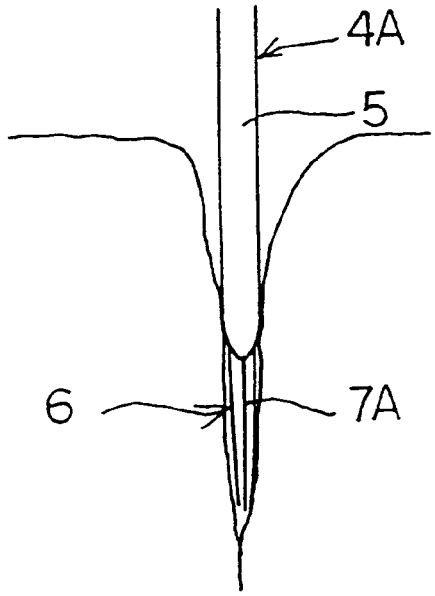
FIGS. 5A and 5B are conceptual diagrams showing how the core filaments of the composite monofilament are inserted into details in the oral cavity.
Figure 5:
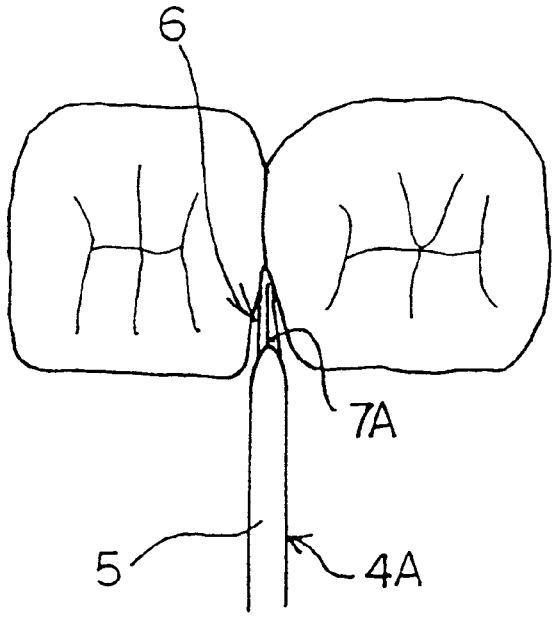

As shown in FIG. 4, the composite portion 5 has such a cross-sectional structure that it consists of three core portions 7 spaced apart from one another and sheath portion 8 which encloses the core portions and fills spaces between the core portions, and the core portions 7 and the sheath portion 8 are integrated with each other.

The separated portion 6 is formed by removing the sheath portion to expose only the core portions 7 at a predetermined length from the composite portion 5 and three core filaments 7A are spaced apart from one another and located at the vertex positions of an equilateral triangle.

Since the sheath portion 8 is present between the core portions 7 without a space left therebetween, water does not remain in the composite portion 5. Therefore, various bacteria do not propagate and the stiffness of the entire composite monofilament is increased.

A predetermined range of an end portion of the composite portion 5 is tapered. The tapering of the composite portion 5 can be carried out simultaneously with the dissolution of the sheath portion 7 which is carried out during the production of the composite fiber and the degree of tapering can be adjusted by controlling the dissolution.

As for the degree of tapering, when a diameter of the root portion is 100% and the boundary between the exposed core filaments and the composite portion is made a reference point, tapering is preferably carried out such that the diameter of the monofilament at a position where the distance "d" from the reference point toward the composite portion is 1 mm becomes 70±15%, the diameter at a position where the distance d is 3 mm becomes 89±8% and the diameter at a position where the distance d is 5 mm becomes 93±7%. The above range of the diameter at each position does not mean that any diameter can be selected if it is within the above range. If the diameter at one position is close to an upper limit of that range, the diameters at other positions are adjusted to values close to upper limits of the respective ranges.

Insertibility into and reachability for details are further enhanced by tapering the composite portion 5. If the degree of tapering is higher than that described above, insertibility into and reachability for details are improved but strength and cleaning properties deteriorate. If the degree of tapering is lower than that described above, strength can be maintained and cleaning properties are improved but insertibility and reachability deteriorate. When the degree of tapering is within the above range, insertibility and reachability are both improved while strength and cleaning properties are maintained.

The core portion 7 (core filament 7A) is made from a polyamide resin whereas the sheath portion 8 is made from a polyester resin. Since the polyamide resin core filament 7A exhibits appropriate water absorption properties and is well adapted to teeth and gum and relatively soft, it does not injure the gum tissue. On the other hand, since the polyester resin sheath portion 8 has low water absorption properties and is excellent in underwater use, it prevents the fatigue of the composite monofilament.

Use of a polyamide resin as a core component and a polyester resin as a sheath component provides an advantage in the production of a filament. That is, the composite monofilament used in the present invention is prepared by first spinning a composite fiber in which a sheath portion is studded with core portions, bundling a large number of the composite fibers, immersing the bundle in a solution and dissolving the sheath portion to a predetermined depth from both end surfaces of the bundle to form a separated portion consisting of exposed core filaments. Since the solution which selectively dissolves only the polyester resin without dissolving the polyamide resin does not cause an increase in viscosity and generates no noxious gas, it has such an advantage that it can be easily handled.

A number of core filaments 7A constituting the separated portion 6 is also important in the present invention. The number of the core filaments 7A is 2 to 5. If the number is more than 5, they may contact one another, thereby causing cracking and producing residual water. The optimal number of core filaments 7A is 3.

The diameters of the composite portion 5 and the core filament 7A and the length of the exposed core filament 7A are also important factors.

A diameter D1 of the composite portion 5 is preferably 0.150 to 0.300 mm. If the diameter is less than 0.150 mm, the stiffness will be insufficient and durability will deteriorate. On the other hand, if the diameter is more than 0.300 mm, the stiffness will be too high and the gum tissue may be injured.

A diameter D2 of the core filament 7A is preferably 0.03 to 0.07 mm. If the diameter is less than 0.03 mm, the core filament 7A will become too soft and the effect of removing plaques with a distal end portion of the core filament 7A cannot be expected. On the other hand, if the diameter is more than 0.07 mm, the distance between the core filaments will be short and the core filaments will contact one another, thereby causing cracking and producing residual water. Reachability for details in the oral cavity will also deteriorate.

A length L1 of the exposed core filament 7A is preferably set to a range of 0.5 to 4.0 mm. If the length is less than 0.5 mm, the core filament 7A will be not long enough to reach the inner parts of the teeth such as interdental portions, cervical portions, pit & fissure. Although the larger the length of the exposed core filament 7A the higher the effect of cleaning thin deep portions becomes, durability deteriorates. The length of the exposed core filament with which practical durability can be maintained is not more than 4.0 mm. A length L1 of the exposed core filament 7A is directly reflected upon reachability for the inner parts of the teeth such as interdental portions, cervical portions, pit & fissure. An average depth of pit & fissure is 1.050 mm and an average width thereof is 0.064 mm (Shika Shinpo, volume 22, pp. 377–381, 1929) and the degree of interdental separation is as follows (J. Japan. Soc. Periodont, volume 31(2), pp. 608–629, 1989).

| Degree of interdental separation | Rate |
|---|---|
| <0.050 μm | 1.8% |
| 0.050 μm | 29.0% |
| 0.110 μm | 21.0% |
| 0.150 μm | 25.0% |
| >0.150 μm | 5.8% |

If the degree of interdental separation is approximately within the above numeral range, the composite monofilament can be used practically.

The diameter D1 of the composite portion 5 is particularly preferably 0.150 to 0.300 mm, the diameter of the core filament 7A particularly preferably 0.03 to 0.05 mm, and the length L1 of the exposed core filament 7A particularly preferably 1.0 to 2.5 mm.

As one of the most preferred examples of the present invention, there is exemplified that the diameter D1 of the composite portion is 0.20 mm, the diameter D2 of the core filament is 0.04 mm, the length L1 of the exposed core filament is 2.00 mm, the number of the core filaments is 3, the core component which is also a material of the core filament is nylon 610, and the sheath component is polybutylene terephthalate which is a saturated polyester resin.

Also, the length from the planted base portion to the distal end of the sheath/core type composite fiber planted is preferably in the range of 7 to 11 mm. If the length is too large, manipulation ease in the mouth will deteriorate and the monofilament will be too soft with the result that a sufficient cleaning effect cannot be obtained. On the other hand, if the length is too small, the fibers will be less flexible during brushing with the result that a feeling of use will be worsened and insertibility into an interdental portion will deteriorate.

Figure 6:
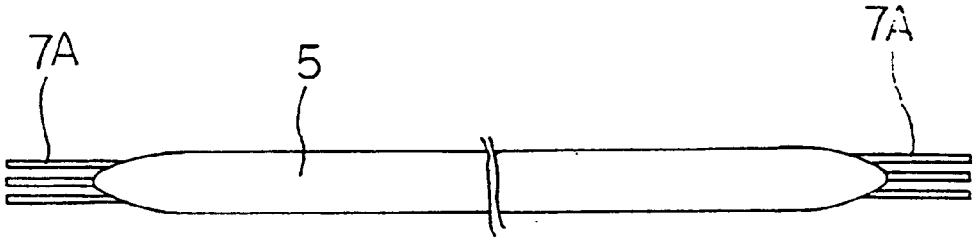
FIG. 6 is a diagram for explaining a composite monofilament before planting.
Figure 7:
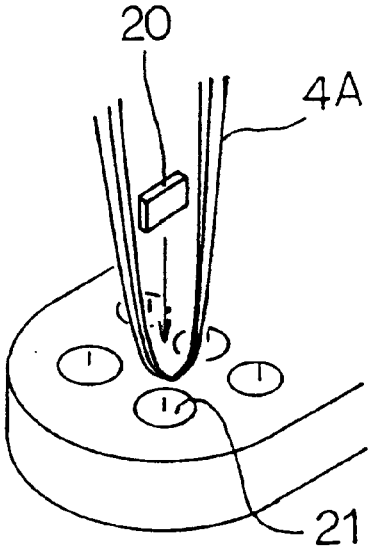
FIG. 7 is a diagram for explaining how the composite monofilament is planted into a planting hole.

The composite monofilament is, as shown in FIG. 6, supplied in such a manner that the core filaments 7A are exposed at both ends or one end thereof. The planting of the composite monofilaments into a planting hole is carried out by bundling 10 to 40 of the composite monofilaments 4A and planting the bundle into a planting hole 21 while an anchor 20 is applied to the bundle at a central position in a longitudinal direction to bend the bundle of the filaments like a U shape as shown in FIG. 7.

The position of bending the composite monofilament 4A is generally the central position in a longitudinal direction of the filament. However, it may be shifted from the central position to produce a difference between the both end positions of the bent filament.

Figure 8:
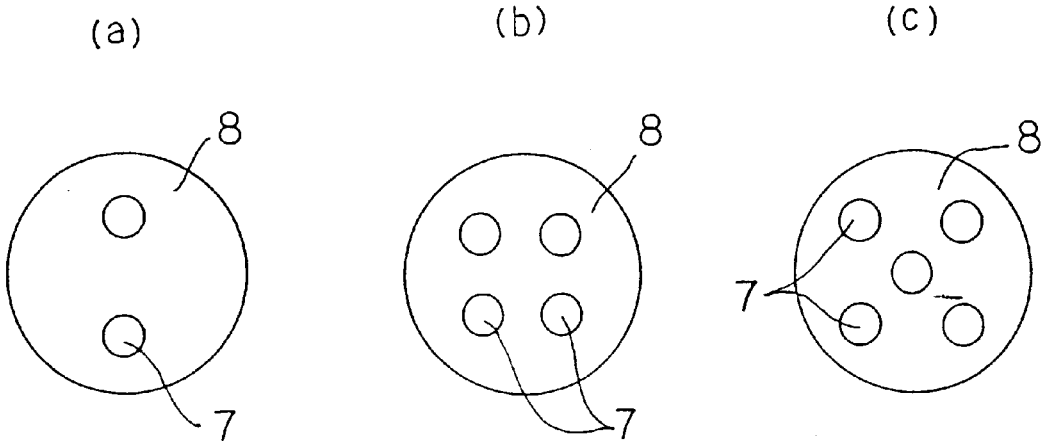
FIGS. 8A to 8C are diagrams showing other examples of a composite monofilament having different numbers of core filaments.
Figure 9:
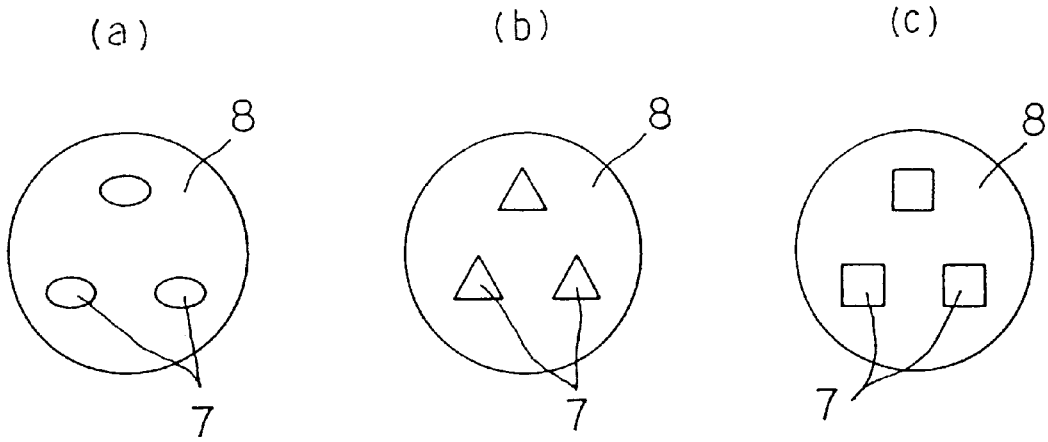
FIGS. 9A to 9C are diagrams showing other examples of a composite monofilament having different core filament shapes.

As the cross-sectional structure of the composite portion 5, various structures may be employed such as one in which two core filaments are formed as shown in FIG. 8A, one in which four core filaments are formed as shown in FIG. 8B, and one in which five core filaments are formed as shown in FIG. 8C, in addition to one shown in FIG. 4. The cross section of the core filament may be elliptic (FIG. 9A), triangular (FIG. 9B), rectangular (FIG. 9C) and the like.

EXAMPLE

Examples of the present invention and tests which have been carried out to verify the effect of these examples are described hereinafter.

A sheath/core type composite fiber in which a sheath portion was studded with three core portions at an area ratio of the sheath portion to the core portions of 9:1 was melt spun using polybutylene terephthalate having an intrinsic viscosity of 1.0 as a sheath component and nylon 610 having a relative viscosity of 2.7 as an core component. The thus obtained composite fiber was extruded into water, cooled to be solidified, drawn to 4.5 times in water heated to 60° C. and then in a dry atmosphere at 120° C., subjected to relaxation thermal setting in a dry heat atmosphere, and taken up in a linear form to obtain a sheath/core type composite fiber having a diameter of 0.200 mm.

The sheath/core type composite fibers thus obtained were bundled to a diameter of 45 mm, packaged and cut to a length of 27 mm. Thereafter, the bundle of the sheath/core type composite fibers was immersed into a heated solution of sodium hydrate while both cut end surfaces were exposed to dissolve and remove the sheath component made from polybutylene terephthalate of both end portions selectively so as to expose the core portions made from nylon 610. After the above treatment was made, a composite monofilament having 2 mm-long exposed core filaments at both ends of the composite portion was obtained.

The 24 composite monofilaments were formed and was implanted into each bundle by an anchor to manufacture a toothbrush having a planted portion consisting of planting holes (3 row, 8 line). The whole shape of the toothbrush was standard as shown in FIG. 1. The composite monofilament after planted have a dimensional relation that a composite portion has a diameter of 0.200 mm and a length of 8.0 mm and exposed core filaments have a diameter of 0.040 mm and a length of 2.0 mm arranged at the end of the composite portion. When regular brushing was carried out using this toothbrush, it was verified that the distal end of the filament could be inserted into an interdental portion, cervical portion, pit or fissure with ease and the filament was stiff enough to remove plaques. This toothbrush having an excellent effect of cleaning details in the oral cavity, was soft to the gum so that it did not injure or hurt the gum tissue, and was excellent in plaque removing effect and durability.

Figure 10:
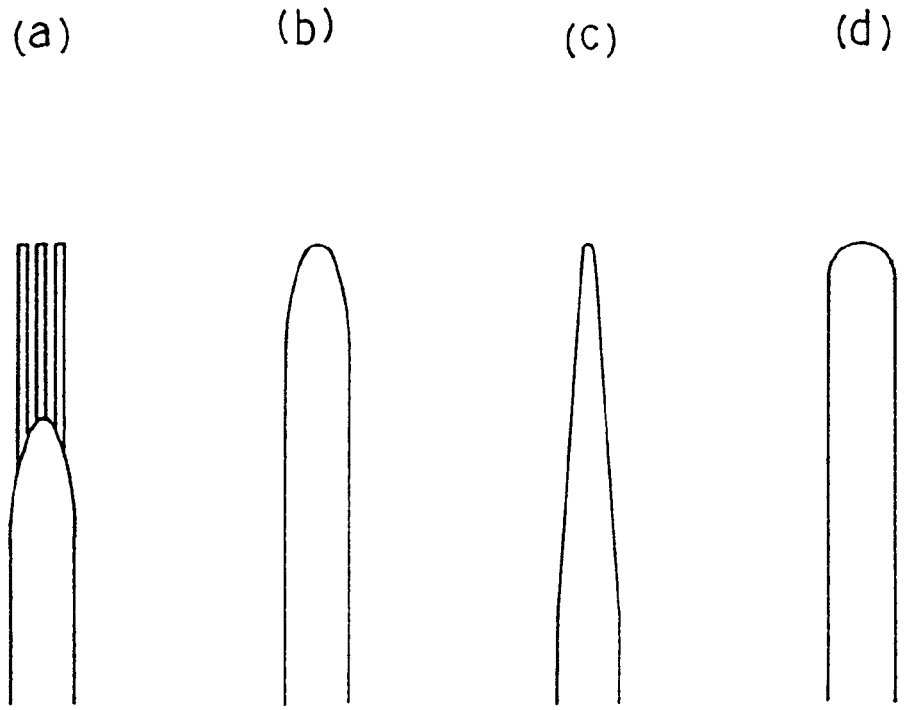

A description is subsequently given of tests which have been conducted to verify these effects. Filaments shown in FIGS. 10A to 10D were used in the tests. FIG. 10A shows a composite monofilament having three core filaments at the end of a composite portion as an example of the present invention. FIG. 10B shows a nylon monofilament whose 1.50 mm end portion is tapered, FIG. 10C shows a nylon monofilament whose 8.00 mm end portion is sharply tapered, and FIG. 10D shows a nylon monofilament whose 0.2 mm end portion is rounded. A diameter of the planted base portion is 0.210 mm for the filament having a tapered end portion in FIG. 10B, 0.180 mm for the filament having a sharply tapered end portion in FIG. 10C and 0.210 mm for the filament having a rounded end portion in FIG. 10D. A diameter of the root portion of the composite portion of example of the present invention is 0.200 mm. Nine samples which differ in the length of the exposed core portion and the diameter of the core portion were prepared for evaluation as examples of the present invention.

(Test 1: cleaning properties for details)

Figure 11:
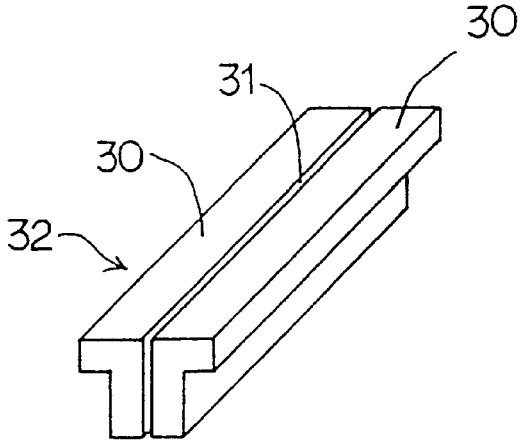
FIG. 11A shows a test tool used for testing cleaning properties for details, 11B a diagram showing the test of cleaning properties for details, and 11C a diagram showing a region where artificial plaque has been removed.
Figure 11:
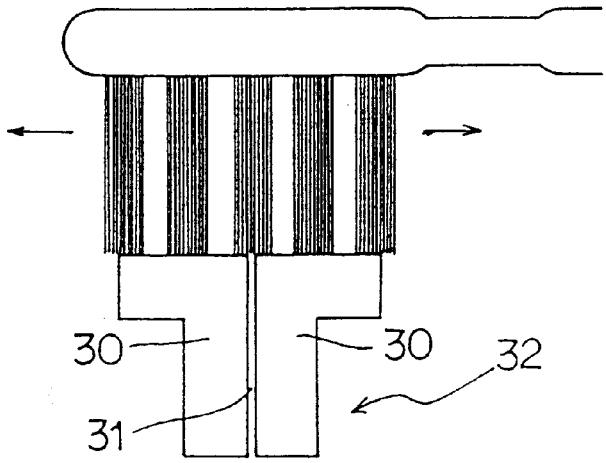
Figure 11:
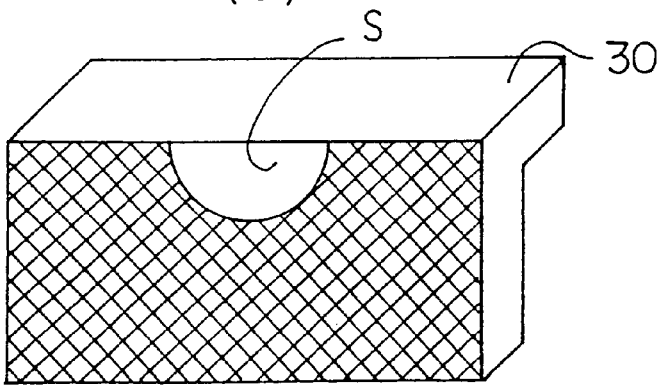

As shown in FIG. 11A, two L-shaped acrylic plates 30 and 30 were arranged to face each other, a 0.1 mm wide groove 31 was formed between the acrylic plates and artificial plaque was applied to opposing surfaces thereof to prepare a test tool 32. A toothbrush was pressed against a top end surface of the test tool 32 by force of a 300 g load as shown in FIG. 11B and brushing was carried out at an amplitude of 5 mm and a speed of 250 rpm in a direction perpendicular to the longitudinal direction of the acrylic plates. As shown in FIG. 11C, cleaning properties for details were evaluated on an area "S" of a region where the artificial plaque on the opposing surfaces of the acrylic plates was removed. The artificial plaque removed area was measured using an image analyzer (LA-555 manufactured by Piers Co.). The results are shown in Table 1. FIGS. 12A to 12D show end portions of the above filaments inserted into the groove and the regions of the artificial plaque to be removed.

TABLE 1

| | Cleaning property for details | | | | |
|---|---|---|---|---|---|
| | Diameter of base portion (mm) | Diameter of core portion (mm) | Length of exposed core portion (mm) | Removal area ($mm^2$) | Evaluation |
| Example 1 | 0.200 | 0.060 | 1.0 | 1.51 | Δ |
| Example 2 | 0.200 | 0.060 | 2.0 | 1.43 | Δ |
| Example 3 | 0.200 | 0.060 | 3.0 | 1.72 | Δ |
| Example 4 | 0.200 | 0.060 | 4.0 | 1.30 | Δ |
| Example 5 | 0.200 | 0.040 | 0.5 | 1.72 | Δ |
| Example 6 | 0.200 | 0.040 | 1.0 | 2.35 | Δ |
| Example 7 | 0.200 | 0.040 | 1.5 | 3.00 | ○ |
| Example 8 | 0.200 | 0.040 | 2.0 | 3.11 | ○ |
| Example 9 | 0.200 | 0.040 | 2.5 | 3.74 | ◎ |
| Toothbrush having taperedend portion | 0.210 | — | — | 0.00 | × |

TABLE 1-continued

| | Cleaning property for details | | | | |
|---|---|---|---|---|---|
| | Diameter of base portion (mm) | Diameter of core portion (mm) | Length of exposed core portion (mm) | Removal area ($mm^2$) | Evaluation |
| Toothbrush having sharply tapered end portion | 0.180 | — | — | 1.00 | × |
| Toothbrush having rounded end portion | 0.210 | — | — | 0.00 | × |

Criteria
◎: Extremely excellent in cleaning properties for details (removal area; not less than 3.5 $mm^2$)
○: Excellent in cleaning properties for details (removal area; not less than 3.0 $mm^2$)
Δ: Having cleaning properties for details (removal area: not less than 1.5 $mm^2$)
×: Having no cleaning properties for details (removal area: less than 1.5 $mm^2$)

It is understood from the test results that all the toothbrushes of examples of the present invention having exposed core filaments at the end of composite filament have cleaning properties for details. Particularly, a toothbrush having a core portion diameter of 0.040 mm and an exposed core portion length of not less than 1.5 mm has extremely excellent cleaning properties for details. In contrast, it was verified that the toothbrushes of comparative examples having a tapered end portion and a sharply tapered end portion have a little cleaning properties for details but are not satisfactory and a toothbrush having a rounded end portion has almost no cleaning properties for details.

Figure 12:
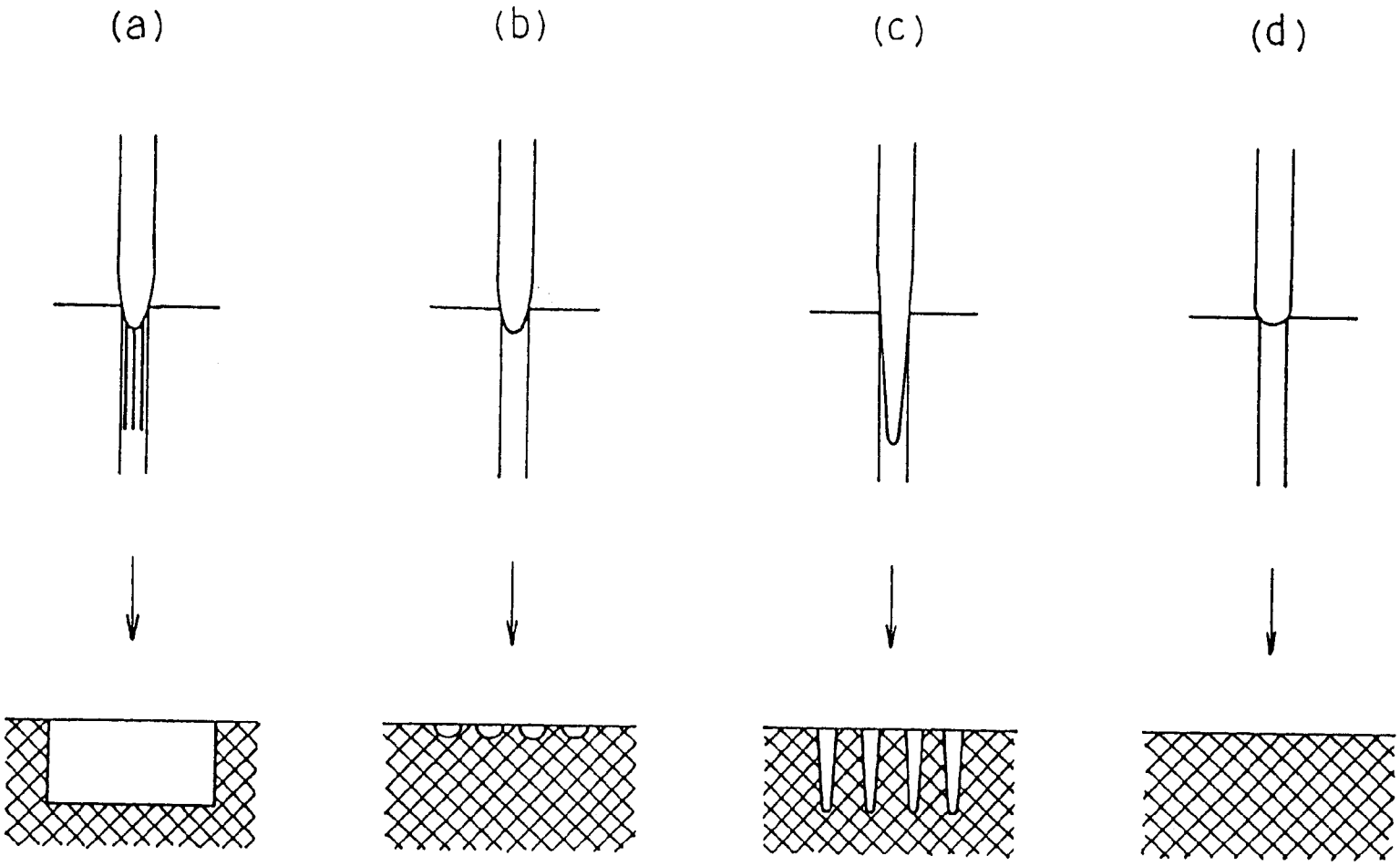
FIGS. 12A to 12D are diagrams showing how the filaments of toothbrushes to be tested are located in the space of a test tool and regions where artificial plaque has been removed by brushing.

The above differences of the artificial plaque removed area are produced as follows. In the toothbrushes of the present invention, the separated portion as a group of core filaments can be inserted deep into the groove and the inserted separated portion can maintain the diameter up to an end portion thereof. In addition, the core filaments constituting the separated portion can sweep the interior surface of the groove independently. Even if all the core filaments cannot be inserted into the groove, some of them can be inserted and hence, can remove the artificial plaque within the width of the planted portion of the toothbrush as shown in FIG. 12A from all that area. On the other hand, as for a toothbrush having a sharply tapered end portion, though the sharply tapered end portion can be inserted into the groove, the artificial plaque cannot be removed completely as shown in FIG. 12C because the filament is tapered off and the number of the end of filaments is only 1 against one filament. The reason why the toothbrush having a rounded end portion has almost no cleaning properties for details is, as shown in FIG. 12D, that the end portion of the filament cannot be inserted into the groove because the width of the groove used in this test is smaller than the width of a groove based on the design concept of these filaments. There are a large number of details in the oral cavity that cannot be cleaned with these toothbrushes having tapered end portion and a rounded end portion. When evaluated from a view point of cleaning properties for details, it is understood that toothbrushes having tapered end portions and a rounded end portion are unsatisfactory in terms of cleaning the oral cavity.

Figure 13:
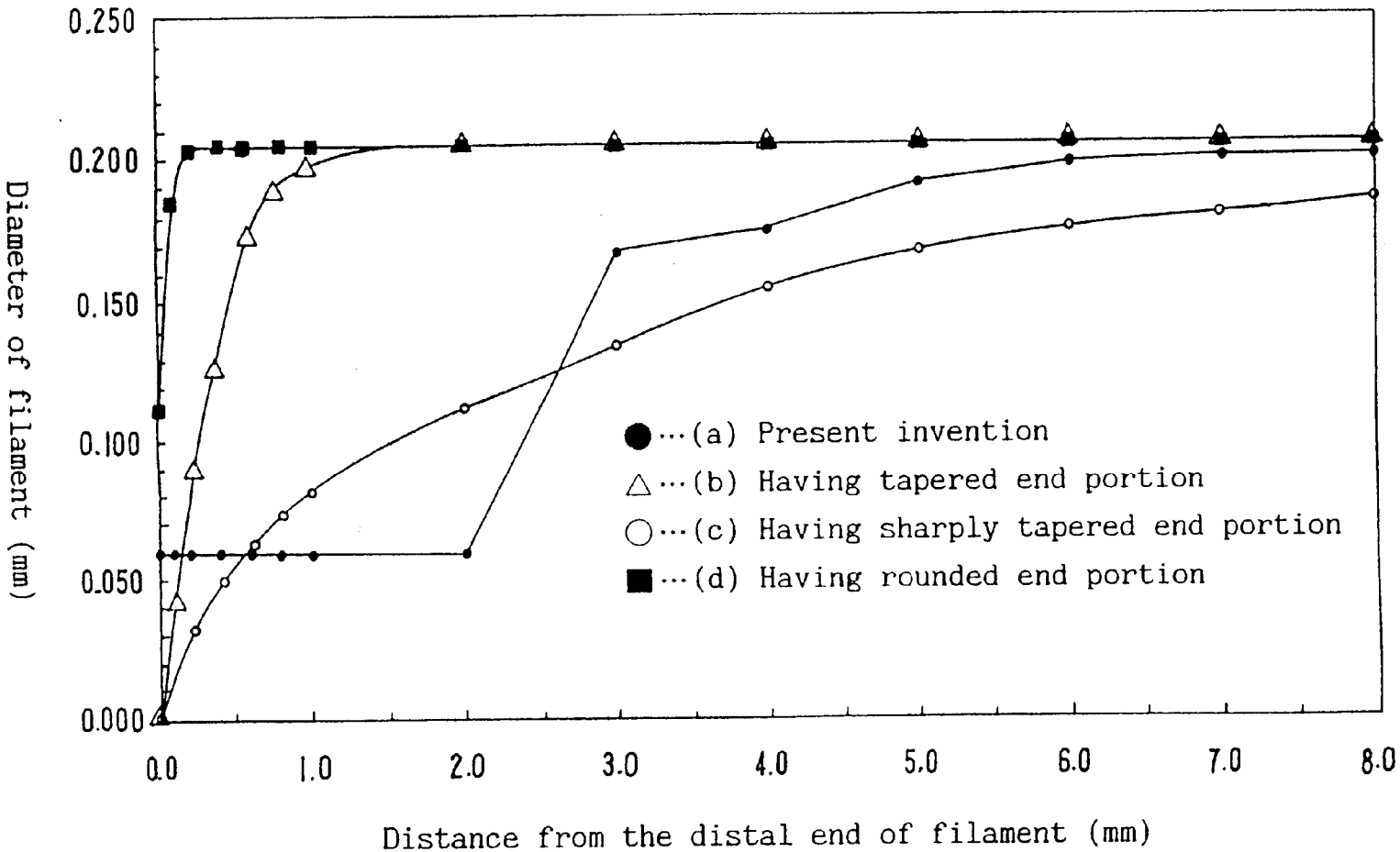
FIG. 13 is a graph showing the relationship between the distance from the end of each filament used in each toothbrush to be tested and the diameter of the filament.

The cleaning properties for details are connected with the insertibility into and reachability for details of a filament, the characteristic properties and form of an inserted filament, the stiffness of the entire filament including a root portion and the like. FIG. 13 is a graph showing the insertibility into and reachability for details of each filament out of these factors. This figure illustrates Example 2 of the present invention as a typical example of the present invention. It is understood from this graph that the reason why Example 2 of the present invention can exhibit cleaning properties for details is that, in the example of the present invention, a group of core filaments having a diameter of 0.06 mm are present up to a position 2.0 mm away from the distal end and each core filament has ability to enter each detail individually whereas the diameters of the filaments having tapered end portions and a rounded end portion are almost the same as those of their planted base portions up to a position close to the ends of the filaments.

(Test 2: durability)

A description is subsequently given of a durability test.

Figure 14:
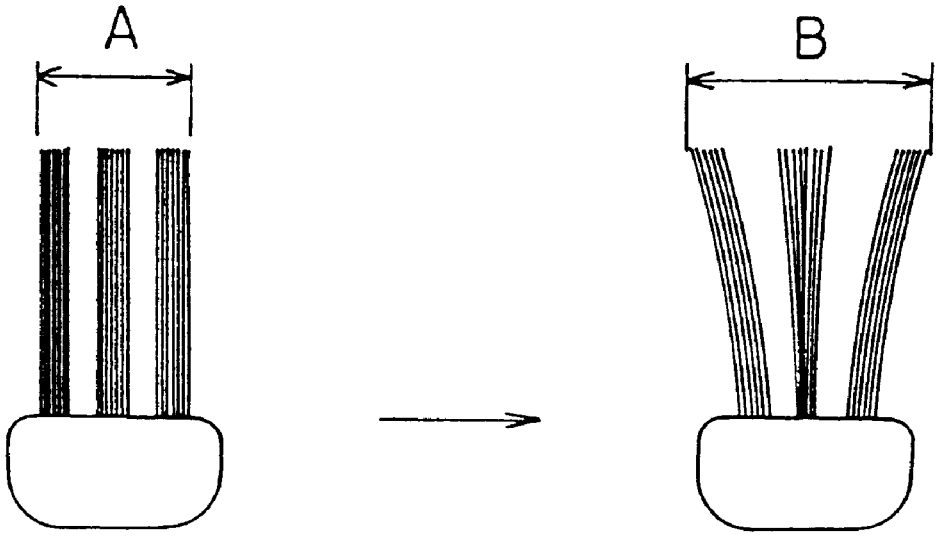
FIGS. 14 are diagrams for explaining a method of evaluating durability.

Using a brushing machine manufactured by Sunstar, Inc., 10,000 strokes of brushing were carried out on the surface of an epoxy plate under a load of 300 g under water at 37° C., and the spread index of a swept surface was measured to evaluate durability. The spread index means a numerical value represented by (B/A)×100 when the horizontal width of the swept surface in an initial state is "A" mm and the horizontal width of the swept surface after brushing is "B" mm as shown in FIGS. 14. The results are shown in Table 2.

TABLE 2

| | Durability | | | | |
|---|---|---|---|---|---|
| | Diameter of base portion (mm) | Diameter of core portion (mm) | Length of exposed core portion (mm) | Spread index (%) | Evaluation |
| Example 1 | 0.200 | 0.060 | 1.0 | 129 | ○ |
| Example 2 | 0.200 | 0.060 | 2.0 | 151 | Δ |
| Example 3 | 0.200 | 0.060 | 3.0 | 155 | Δ |
| Example 4 | 0.200 | 0.060 | 4.0 | 160 | Δ |
| Example 5 | 0.200 | 0.040 | 0.5 | 109 | ◎ |
| Example 6 | 0.200 | 0.040 | 1.0 | 110 | ◎ |
| Example 7 | 0.200 | 0.040 | 1.5 | 124 | ○ |
| Example 8 | 0.200 | 0.040 | 2.0 | 130 | ○ |
| Example 9 | 0.200 | 0.040 | 2.5 | 154 | Δ |
| Toothbrush having tapered end portion | 0.210 | — | — | 173 | Δ |
| Toothbrush having sharply tapered end portion | 0.180 | — | — | 181 | × |
| Toothbrush having rounded end portion | 0.210 | — | — | 170 | Δ |

Criteria
◎: Extremely durability (spread index < 110)
○: High durability (110 < spread index < 130)
Δ: Moderate durability (130 < spread index < 180)
×: Low durability (180 < spread index)

It is understood from the test results that the examples of the present invention have less fatigue and are superior in durability to toothbrushes having sharply tapered end portion, tapered end portions and a rounded end portion as comparative examples. Particularly, a toothbrush having an exposed core portion length of not more than 1.0 mm has extremely small fatigue. This is because the shorter the exposed core filaments, the physically stronger the core filaments become.

(Test 3: feeling of use)

A sensory test was made on a feeling of use. Fifteen employees of Sunstar, Inc. used the toothbrush of the present invention and two different toothbrushes as comparative examples alternately for 30 days (the total number of days using each toothbrush is 10) and answered questionnaires. Questions are about bleeding and irritation. The results are shown in Table 3. Example 8 typifies the present invention.

TABLE 3

| | | | | Feeling of use | | | | | | | | |
|---|---|---|---|---|---|---|---|---|---|---|---|---|
| | | | Length of exposed | Bleeding | | | Irritation | | | | | |
| | | | | | | | Hard | | | | | |
| | Diameter of base portion (mm) | Diameter of core portion (mm) | core portion (mm) | Frequently (%) | Sometimes (%) | No bleeding (%) | Feel much (%) | Feel slightly (%) | to say (%) | Rarely feel (%) | Do not feel (%) | Evaluation |
| Example 1 | 0.200 | 0.060 | 1.0 | — | — | — | — | — | — | — | — | Δ |
| Example 2 | 0.200 | 0.060 | 2.0 | — | — | — | — | — | — | — | — | Δ |
| Example 3 | 0.200 | 0.060 | 3.0 | — | — | — | — | — | — | — | — | Δ |
| Example 4 | 0.200 | 0.060 | 4.0 | — | — | — | — | — | — | — | — | Δ |
| Example 5 | 0.200 | 0.040 | 0.5 | — | — | — | — | — | — | — | — | ○ |
| Example 6 | 0.200 | 0.040 | 1.0 | — | — | — | — | — | — | — | — | ○ |
| Example 7 | 0.200 | 0.040 | 1.5 | — | — | — | — | — | — | — | — | ◎ |
| Example 8 | 0.200 | 0.040 | 2.0 | 0 | 1 | 93 | 0 | 0 | 13 | 27 | 60 | ◎ |
| Example 9 | 0.200 | 0.040 | 2.5 | — | — | — | — | — | — | — | — | ○ |
| Toothbrush having tapered end portion | 0.210 | — | — | 0 | 27 | 73 | 0 | 47 | 20 | 27 | 7 | × |
| Toothbrush having sharply tapered end portion | 0.180 | — | — | 7 | 33 | 60 | 13 | 40 | 20 | 20 | 7 | × |
| Toothbrush having rounded end portion | 0.210 | — | — | — | — | — | — | — | — | — | — | × |

As shown in Table 3, the toothbrush of the present invention is superior in feeling of use with little bleeding and no irritation such as a pain or prickling. In contrast, toothbrushes having a tapered end portion and a sharply tapered end portion as comparative examples cause excessive loss of blood and irritates a lot. In the example of the present invention, since thin and soft core filaments come into contact, they touch soft and rarely irritate. On the other hand, since the filament of a toothbrush having a tapered end portion is thick and hard up to a position where it contacts the gum, it irritates a lot. The end portion of a toothbrush having a sharply tapered end portion is hard and sharp.

The results of overall evaluations on cleaning properties for details, durability and a feeling of use are shown in Table 4.

As was described above, the toothbrush of the present invention is satisfactory in all of cleaning properties, durability and a feeling of use and can be rated extremely high as a toothbrush which lays stress on cleaning properties for details.

Since the toothbrush of the present invention uses a composite monofilament in which a composite portion having a polyester resin sheath portion studded with 2 to 5 of polyamide resin core portions is present over a predetermined range from a planted base portion and a separated portion consisting of 2 to 5 of core filaments formed by exposing a predetermined length of the core portions only is

TABLE 4

| | Overall evaluation | | | | | | |
|---|---|---|---|---|---|---|---|
| | Diamter of base portion (mm) | Diameter of core portion (mm) | Length of exposed core portion (mm) | Cleaning properties | Durability | Feeling of use | Overall evaluation |
| Example 1 | 0.200 | 0.060 | 1.0 | Δ | ○ | — | Δ |
| Example 2 | 0.200 | 0.060 | 2.0 | Δ | Δ | — | Δ |
| Example 3 | 0.200 | 0.060 | 3.0 | Δ | Δ | — | Δ |
| Example 4 | 0.200 | 0.060 | 4.0 | Δ | Δ | — | Δ |
| Example 5 | 0.200 | 0.040 | 0.5 | Δ | ◎ | — | ○ |
| Example 6 | 0.200 | 0.040 | 1.0 | Δ | ◎ | — | ○ |
| Example 7 | 0.200 | 0.040 | 1.5 | ○ | ○ | — | ◎ |
| Example 8 | 0.200 | 0.040 | 2.0 | ○ | ○ | good | ◎ |
| Example 9 | 0.200 | 0.040 | 2.5 | ◎ | Δ | — | ○ |
| Toothbrush having tapered end portion | 0.210 | — | — | × | Δ | medium | × |
| Toothbrush having sharply tapered end portion | 0.160 | — | — | × | × | bad | × |
| Toothbrush having rounded end portion | 0.210 | — | — | × | Δ | — | × |

present on the side of a distal end thereof from the composite portion, all or part of the core filaments constituting the separated portion are inserted into details in the oral cavity which are sites to be cleaned and reach the inner part of each detail, and the composite portion located behind the core filaments serves to maintain the stiffness of the whole composite filament. Therefore, plaques in details in the oral cavity where plaques are liable to accumulate and it is difficult to remove the plaques by an ordinary brush, such as an interdental portion, cervical portion, pit & fissure, can be removed effectively.

Since the core filaments are thin and soft and made from a polyamide resin, they have appropriate water absorption properties and are well adapted to the tooth and gum, they do not injure or hurt the gum tissue.

Since the sheath portion is present between the core portions such that it fills spaces between the core portions in the composite portion, water does not enter the composite position and remains therein, and the composite portion does not crack from the core filament base portion during use. In addition, since the sheath portion is made from a polyester resin, it has low water absorption properties and is excellent in underwater use.

Thus, according to the present invention, a toothbrush which is almost satisfactory in terms of all of cleaning properties for details, durability and feeling of use which have been difficult to be satisfied at the same time can be obtained.

When a diameter of the composite portion is set to 0.150 to 0.300 mm, a diameter of the core filament to 0.03 to 0.07 mm and a length of the exposed core filament to 0.2 to 4.0 mm, the insertibility into details in the oral cavity and reachability for the inner part of each detail in the oral cavity and the plaques removing function with the reached core filaments of the toothbrush are more preferred. When the length of an exposed core filament is set to 0.5 to 4.0 mm, the insertibility into details in the oral cavity and reachability for the inner part of each detail in the oral cavity and the plaque removing function with the reached core filaments of the toothbrush are much more preferred.

Further, when the diameter of the composite portion is set to 0.150 to 0.300 mm, the diameter of the core filament to 0.03 to 0.05 mm and the length of the exposed core filament to 1.0 to 2.5 mm, the insertibility into details in the oral cavity and reachability for the inner part of each detail in the oral cavity and the plaque removing function with the reached core filaments of the toothbrush are the most preferred.

When a length from the planted base portion to the distal end of the sheath/core type composite fiber planted is in the range of 7 to 11 mm, a toothbrush has a sufficient stiffness for obtaining a cleaning effect and excellent insertibility into an interdental portion and is easily manipulated.

When a predetermined range of the end portion of the composite portion is tapered, insertibility into and reachability for details are further improved. Particularly, when a diameter of the root portion of the composite portion is 100% and the boundary between the exposed core filaments and the composite portion is made a reference point, the end portion of the composite portion is tapered such that the diameter of a composite portion at a position 1 mm from the reference point toward the side of the composite portion is 70±15%; a diameter at a position 3 mm from the reference point, 89±8%; and a diameter at a position 5 mm from the reference point, 93±7%. In this case, the toothbrush can exhibit excellent insertibility and reachability while maintaining sufficient strength and cleaning properties.

What is claimed is:

1. A toothbrush comprising by planting sheath/core type composite fibers in a planting base, wherein:

said sheath/core type composite fiber further comprises:

a composite portion consisting of a sheath portion made from polyester resin and 2 to 5 of core portions made from polyamide resin dispersed therein having a predetermined length from a planted base portion; and 2 to 5 of exposed core filament portions obtained by exposing said core portions only having a predetermined length on an end side from the composite portion.

2. A toothbrush as claimed in claim 1, wherein a diameter of said composite portion is 0.150 to 0.300 mm, and a diameter and a length of said exposed core filament are 0.03 to 0.07 mm and 0.2 to 4.0 mm, respectively.

3. A toothbrush as claimed in claim 1, wherein a diameter of said composite portion is 0.150 to 0.300 mm, and the diameter and the length of said exposed core filament are 0.03 to 0.07 mm and 0.5 to 4.0 mm, respectively.

4. A toothbrush as claimed in any one of claims 1 to 3, wherein a length from the planted base portion to the distal end of planted sheath/core type composite fiber is 7 to 11 mm.

5. A toothbrush as claimed in any one of claims 1 to 3, wherein a predetermined range of an end side portion of said composite portion is tapered.

6. A toothbrush as claimed in claim 5, wherein when a diameter of a root portion of said composite portion is 100% and the boundary between the exposed core filament and the composite portion is made a reference point, said tapered composite portion has diameters of 70±15%, 89±8%, and 93±7% at positions 1 mm, 3 mm, and 5 mm from the reference point toward the composite portion, respectively.

* * * * *